US005980436A

United States Patent [19]

Cheng

[11] Patent Number: 5,980,436

[45] Date of Patent: Nov. 9, 1999

[54] THIGH EXERCISER

[76] Inventor: Chen Cheng Cheng, P.O. Box 82-144, Taipei, Taiwan

[21] Appl. No.: 08/814,814

[22] Filed: Mar. 11, 1997

[51] Int. Cl.[6] ..... A63B 21/02

[52] U.S. Cl. ..... 482/124; 482/121; 482/122

[58] Field of Search ..... 482/121, 122, 482/124, 126

[56] References Cited

U.S. PATENT DOCUMENTS

| | | | |
|---|---|---|---|
| 4,515,364 | 5/1985 | Rotella | 482/122 |
| 5,222,926 | 6/1993 | Eggen | 482/122 |
| 5,292,295 | 3/1994 | Gerlach | 482/121 |

FOREIGN PATENT DOCUMENTS

| | | | |
|---|---|---|---|
| 3719719 | 12/1988 | Germany | 482/121 |

*Primary Examiner*—Lynne A. Reichard
*Attorney, Agent, or Firm*—A & J

[57] ABSTRACT

A thigh exerciser includes a primary elongated member made of resilient material, two curved supporters engaged with two ends of the primary elongated member, a secondary elongated member detachably fitted in the primary elongated member, and two straps each extending through two slots of each of the curved supporters, whereby the thigh exerciser can strengthen various body muscules and more particularly to thigh muscules.

2 Claims, 3 Drawing Sheets

THIGH EXERCISER

BACKGROUND OF THE INVENTION

1. Field of the Invention

This invention is related generally to an exerciser especially designed for strengthening various body muscles and more particularly to exercise devices intended to strengthen thigh muscles.

2. Description of the Prior Art

It has been found that the conventional leg exerciser allows leg exercises to be performed by using the legs to rotate a crossbar or to move the crossbar back and forth. Spring tension is varied by replacing the spring with a stronger or weaker spring or altering the angular portion of the socket assembly. However, such an exerciser is complex, expensive to manufacuture, and does not exercise groups exercised by the present invention.

Prior art as discussed above exhibits complex, costly and/or non-specific exercisers for the muscle groups of the inner thighs of a person. The present invention discloses a non-complex, inexpensive device, and convenient-to-use device for specifically exercising the muscules of the inner thighs. The present invention is portable and ready for use requirimg no assembly or adjustment.

SUMMARY OF THE INVENTION

This invention is related to a thigh exerciser.

It is the primary object of the present invention to provide a thigh exerciser which can effectively reduce the fat in the thighs.

It is another object of the present invention to provide a thigh exerciser which can strengthen various body muscules and more particularly to thigh muscules.

It is still another object of the present invention to provide a thigh exerciser which can strengthen the vaginal muscules thereby curing the slack urethra.

It is still another object of the present invention to provide a thigh exerciser which can promote the blood circulation.

It is still another object of the present invention to provide a thigh exerciser which is simple in construction and cheap in cost.

It is still another object of the present invention to provide a thigh exerciser which can be adjusted in resiliency.

It is a further object of the present invention to provide a thigh exerciser which enables a user to do other things with his hands while doing exercise.

The foregoing objects and summary provide only a brief introduction to the present invention. To fully appreciate these and other objects of the present invention as well as as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
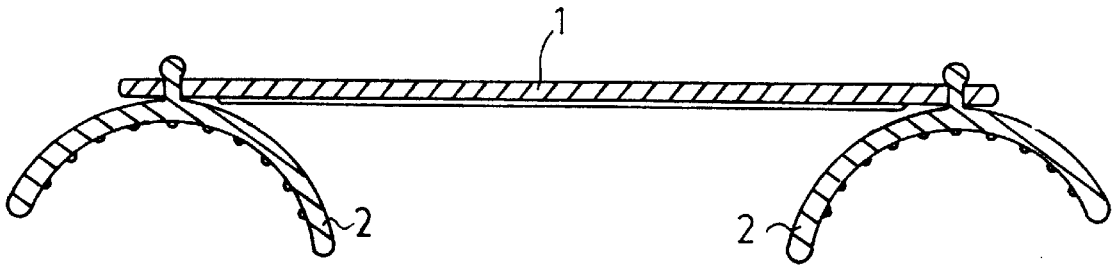
FIG. 1 is a sectional view of the present invention.
Figure 2:
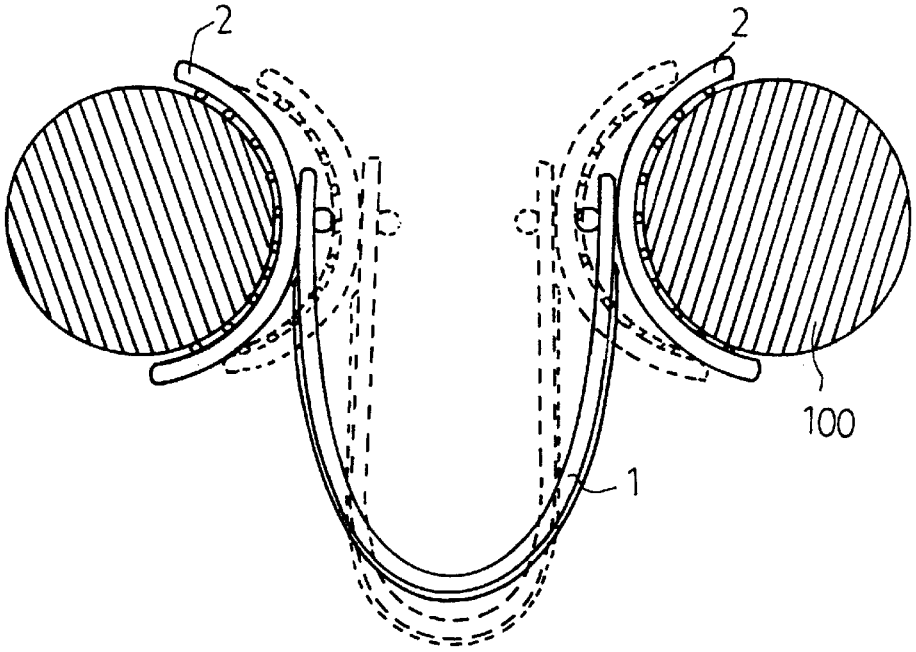
FIG. 2 illustrates the working principle of the present invention.
Figure 3:
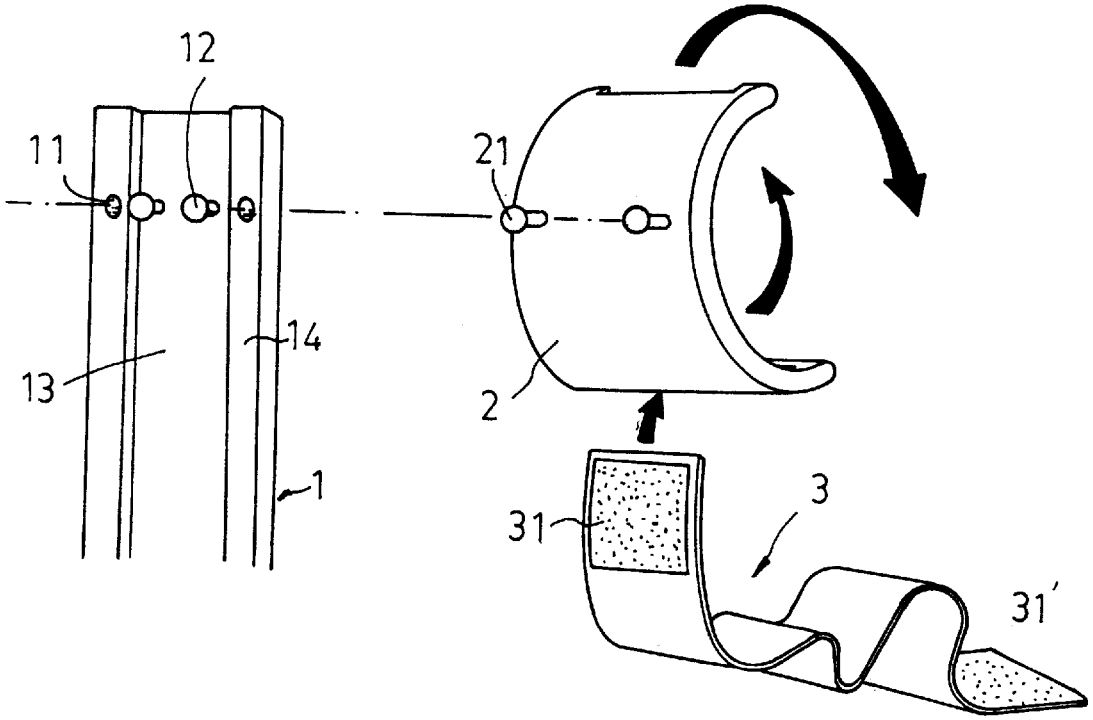
FIG. 3 illustrates how to connect the strap and the elongated resilient member with the curved member.
Figure 4:
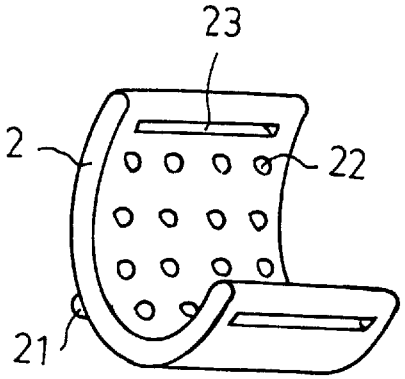
FIG. 4 is a perspective of the curved member.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 4, the thigh exerciser according to the present invention basically comprises a primary elongated member 1, a pair of curved supporters 2, two straps 3 and a secondary elongated member 18.

As shown, the primary elongated member 1 is made of resilient material and formed two longitudinal shoulders 14 on its outer side, a longitudinal recess 13 between the two longitudinal shoulders 14, two pairs of protuberances 12 provided on two opposite ends of the recess 13 of the longitudinal recess 13, and two pairs of through holes 11 on two opposite ends of the longitudinal shoulders 14.

The curved supporter 2 is a semi-cylindrical member which is formed with two slots 22 at two opposite ends, a plurality of projections 22 at an inner side, and two protuberances 21 at an intermediate portion adapted to engage with the through holes 11 of the primary elongated member 1.

The strap 3 is provided with a rough nylon strip 31 and a smooth nylon strip 31' which will stick to each other when pressed together. The strap 3 is inserted through the two slots 23 of the curved supporter 2 so that the curved supporter 2 can be firmly fitted on the thigh of an user.

Figure 5:
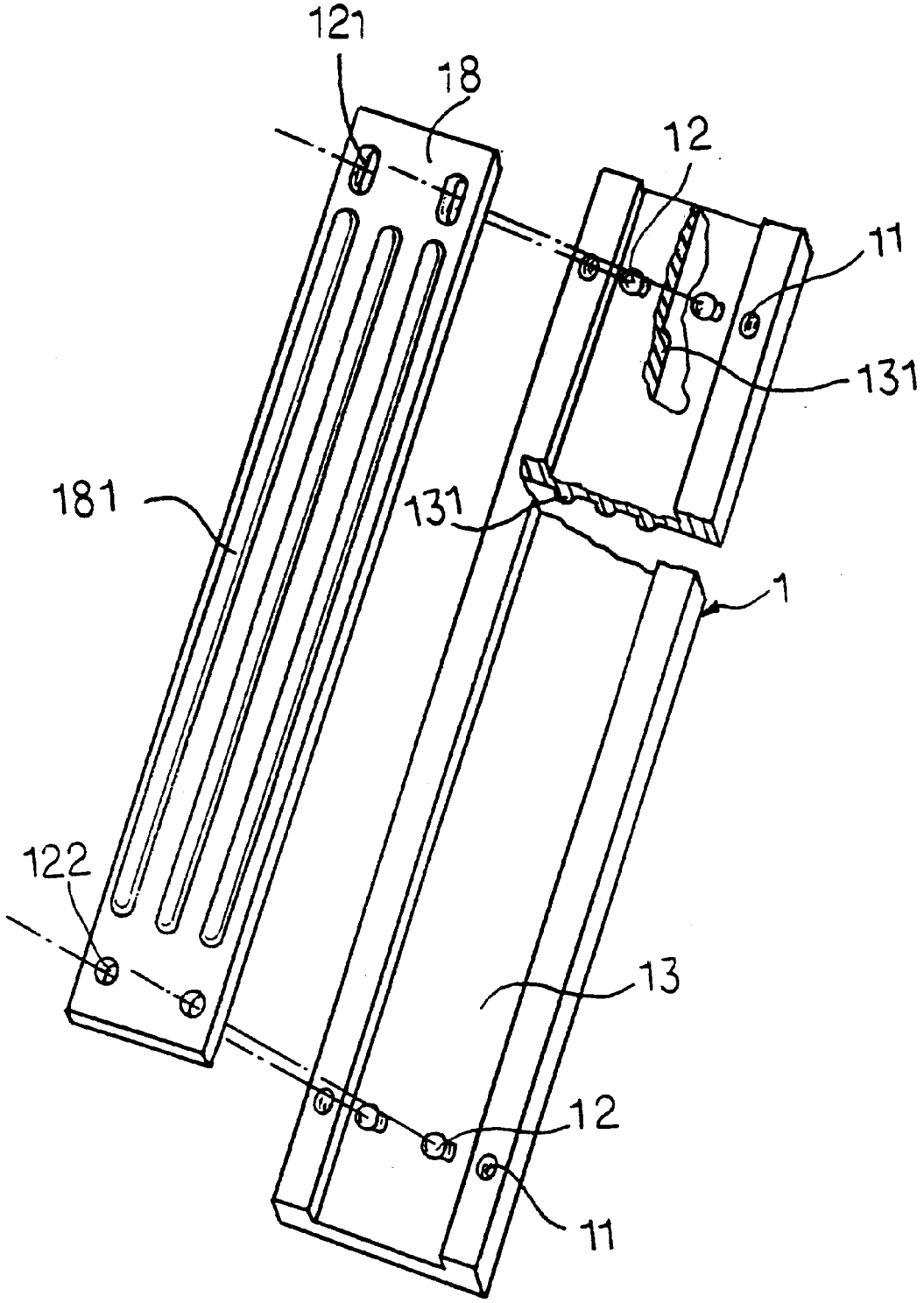
FIG. 5 illustrates the relationship between the primary resilient plate and the secondary resilient plate.

The secondary elongated member 18 is also made of resilient material and formed with two slots 121 at an end and two holes 122 at the other. The secondary elongated member 18 is fitted in the longitudinal recess 13 of the primary elongated member, with the slots 121 and the holes 122 of the former engaged with the protuberances 11 of the latter. Further, in order to increase the strength and durability of the present invention, the primary and second elongated members 1 and 18 may be formed with a plurality of ribs 131 and 181, respectively (see FIG. 5).

When in use, simply mount the curved supporters 2 on the respective inner sides of the thighs 100 of an user (see FIG. 2) with the straps 3. Then, the user may use his thighs to compress the curved supporters 2 thereby enabling the user to exercise without his hands. If desired to increase the resiliency of the present invention, it is only necessary to fit the secondary elongated member 18 in the recess 13 of the primary elongated member 12.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A thigh exerciser comprising:

a primary elongated member made of resilient material and formed two longitudinal shoulders on an outer side thereof, a longitudinal recess between said two longitudinal shoulders, two pairs of protuberances provided on two opposite ends of said recess, and two pairs of through holes on two opposite ends of said longitudinal shoulders;

two curved supporters each having an outer side provided with two protuberances at an intermediate portion thereof engaged with said two holes of said primary elongated member, each of said curved members having two slots at two opposite ends thereof;

a secondary elongated member detachably fitted in said recess and having two holes at both ends thereof adapted to engage with said proterances of said primary elongated member; and two straps each extending through said slots of each of said curved supporters.

2. The thigh exerciser as claimed in claim 1, wherein each of said curved supporter has an inner surface provided with a plurality of protuberances.

* * * * *